US006684537B2

(12) United States Patent
Ichikawa et al.

(10) Patent No.: US 6,684,537 B2
(45) Date of Patent: Feb. 3, 2004

(54) EXCAVATOR WITH A PIPING STRUCTURE FOR ABSORBING VARIATIONS IN HOSE LENGTH

(75) Inventors: Toshiki Ichikawa, Sakai (JP); Takeshi Ikumura, Osaka (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 10/083,627

(22) Filed: Feb. 26, 2002

(65) Prior Publication Data

US 2002/0174573 A1 Nov. 28, 2002

(30) Foreign Application Priority Data

May 28, 2001 (JP) ..... 2001-159539
May 28, 2001 (JP) ..... 2001-159540

(51) Int. Cl.[7] ..... E02F 9/00; E02F 3/36
(52) U.S. Cl. ..... 37/347; 37/466
(58) Field of Search ..... 37/347, 466, 902, 37/348; 248/24, 27, 120.1, 121.1

(56) References Cited

U.S. PATENT DOCUMENTS

| | | | |
|---|---|---|---|
| 3,270,894 A | | 9/1966 | Elliott et al. |
| 6,053,257 A | | 4/2000 | Sugiyama et al. |
| 2002/0062587 A1 | * | 5/2002 | Kimoto et al. |

FOREIGN PATENT DOCUMENTS

| | | | | |
|---|---|---|---|---|
| DE | 16 34 887 | | 10/1976 | |
| EP | 0 383 276 A1 | | 8/1990 | |
| GB | 2 111 015 A | | 6/1983 | |
| JP | 56108424 A | * | 8/1981 | E02F/9/14 |
| JP | 05098664 A | * | 4/1993 | E02F/9/00 |
| JP | 07018693 A | * | 1/1995 | E02F/3/36 |
| JP | 07062680 A | * | 3/1995 | E02F/3/36 |
| JP | 07180171 A | * | 7/1995 | E02F/3/36 |
| JP | 07317329 A | * | 12/1995 | E02F/9/00 |
| JP | 08302726 A | * | 11/1996 | E02F/3/36 |
| JP | 9-60039 | | 3/1997 | |
| JP | 09209385 A | * | 8/1997 | E02F/9/00 |
| JP | 10331184 A | * | 12/1998 | E02F/9/00 |
| JP | 11131520 A | * | 5/1999 | E02F/3/38 |
| JP | 11200408 A | * | 7/1999 | E02F/9/00 |
| JP | 200096610 | | 4/2000 | |
| JP | 2000096597 A | * | 4/2000 | E02F/3/38 |
| JP | 2000345582 A | * | 12/2000 | E02F/9/00 |

* cited by examiner

*Primary Examiner*—Thomas B. Will
*Assistant Examiner*—Alexandra K. Pech'hold
(74) *Attorney, Agent, or Firm*—Webb Ziesenheim Logsdon Orkin & Hanson, P.C.

(57) ABSTRACT

An excavator such as a backhoe has a group of hoses variable in length when a boom moves up and down. To avoid the group of hoses bulging to obstruct view when the boom is raised to an uppermost position, the group of hoses has a length absorbing portion disposed in a swivel base instead of being disposed on a boom as in the prior art.

6 Claims, 10 Drawing Sheets

EXCAVATOR WITH A PIPING STRUCTURE FOR ABSORBING VARIATIONS IN HOSE LENGTH

BACKGROUND OF THE INVENTION

1. Field of the Invention

This invention relates to an excavator such as a backhoe, and more particularly to a piping structure for supplying and draining pressure oil to/from a boom cylinder, an arm cylinder and a bucket cylinder.

2. Description of the Related Art

An excavator such as a backhoe has an excavating implement attached to the front of a swivel base (vehicle body). The excavating implement includes a boom movable up and down by a boom cylinder, an arm pivotally attached to a distal end of the boom to be swingable by an arm cylinder, and a bucket pivotally attached to a distal end of the arm to be swingable by a bucket cylinder to take dumping and scooping action. These cylinders are connected to control valves arranged on the swivel base, through a group of flexible hoses, to supply and drain pressure oil to/from the cylinders.

This excavating implement has the boom movable up and down, the swingable arm, and the bucket taking dumping and scooping action. To operate (i.e. drive) these components, the cylinders are connected through flexible hydraulic hoses to control valves arranged on the swivel base (vehicle body).

The hydraulic hoses have lengths thereof to the control valves variable from a lowermost position to an uppermost position of the boom. Such variations in hose length are accommodated by the flexibility and intermediate slacks of the hoses. Conventionally, however, the above slacks, i.e. curves for absorbing differences in hose length, are formed adjacent a bottom portion of the boom. When the boom moves up and down, the curves undergo changes in size. When the boom moves up, the curves protrude to a large extent toward the swivel base (vehicle body). This impairs operability and particularly visibility during an excavating operation. In order to dig a ditch or the like, the boom is pivotally attached to a swing bracket swingable right and left, to be vertically movable (up and down). Thus, the boom is movable up and down and right and left, and the flexible hydraulic hoses must follow such movements. This tends to cause twisting of the hoses, thereby impairing durability of the hoses.

As a conventional example, a small backhoe is described in Japanese Patent Laying-Open Publication H9-60039. This backhoe includes a swivel body mounted on a traveling device to be rotatable about a vertical axis, and an excavating implement. The latter has a boom pivotally attached to the swivel body to be swingable about a horizontal pivot, an arm pivotally attached to a distal end of the boom, and a bucket attached to a distal end of the arm for scooping and dumping action. A control valve unit is mounted in the swivel body for supplying pressure oil to various actuators to drive the excavating implement and the traveling device in the form of caterpillar tracks.

Since the boom of the excavating implement is vertically swingable about the pivot, flexible hydraulic hoses are employed as hydraulic piping for supplying pressure oil to the hydraulic cylinders disposed on the boom. The hydraulic hoses are arranged to have allowances in length adjacent the pivotal connection of the boom. In arranging the hydraulic hoses are arranged to have allowances in length adjacent the pivotal connection of the boom, the above conventional backhoe passes the flexible hydraulic hoses through an area far rearwardly (close to the swivel body) of the pivot of the boom (see FIG. 6 of Patent Laying-Open Publication H9-60039). Consequently, when the boom is raised to its uppermost position, the hydraulic hoses bulge to a large extent rearward. The bulging hydraulic hoses impose corresponding restrictions on an operator-accommodating space on the swivel body. The bulging hydraulic hoses also present an obstruction to impair operability.

The conventional boom (boom structure) has a forked proximal end extending a main boom body and having a collar or bush mounted in between. The swing bracket has a forked portion that sandwiches the forked end of the boom, with a horizontal pivot extending through the bush for pivotally attaching the boom to be movable up and down. This construction requires the forked proximal end of the long, large boom structure to be machined. Such a machining process is troublesome and with low machining accuracy.

To solve such a problem, Japanese Patent Laying-Open Publication No. 2000-96610 proposes the following excavators. One is an excavator having a swing bracket pivotally attached to a swivel base to be swingable about a vertical axis, and a boom structure with a proximal end thereof attached to the swing bracket to be movable up and down about a horizontal pivot, characterized in that the swing bracket is pivotally attached through the horizontal pivot to the swing bracket sandwiched by the proximal end, a space surrounded by the proximal end being formed forwardly of the pivot, a group of hoses for pressure oil having passed the swing bracket passing upward through that space.

Another is an excavator having a swing bracket pivotally attached to a swivel base to be swingable about a vertical axis, and a boom structure with a proximal end thereof attached to the swing bracket to be movable up and down about a horizontal pivot, characterized in that the swing bracket as sandwiched by the swing bracket is pivotally attached through the horizontal pivot to the swing bracket, a space surrounded by the proximal end being formed forwardly of the pivot, a group of hoses for pressure oil having passed the swing bracket passing upward through that space.

These prior constructions (proposed techniques) overcome various disadvantages caused by bulging of the group of hoses occurring with vertical movements of the boom. However, such bulging cannot be avoided entirely since the group of hoses is not guided in the space. Where the above space is enlarged by elongating the proximal end in order to prevent the bulging entirely, an excessive moment will act on the pivot. This results in a concentration of stress and a lower excavating performance.

SUMMARY OF THE INVENTION

An object of this invention is to provide a swivel working vehicle overcoming the above inconveniences. Specifically, the invention intends to provide a swivel working vehicle including a swivel base having a curved length absorbing portion for absorbing differences in hose length occurring with vertical movements of a boom, to realize excellent visibility, and hence operability, and significantly improve the durability of hoses.

Another object of this invention is to provide an excavator and a boom structure which achieve excellent visibility to improve excavating performance significantly by retaining the advantage of the above proposed technique and with a simple technique of forming a hose guide surface in a forked proximal end.

The above objects are fulfilled, according to this invention, by an excavator comprising:

a traveling device;

an excavating implement including a boom movable up and down by a boom cylinder, an arm pivotally attached to a top end of the boom to be swingable by an arm cylinder, and a bucket pivotally attached to a top end of the arm to be driven by a bucket cylinder for scooping and dumping action;

a swivel base supported by the running device and supporting the excavating implement, the swivel base having control valves for supplying and draining pressure oil to/from the cylinders, respectively; and a group of flexible hoses connected between the control valves and the cylinders for transmitting the pressure oil therebetween, the group of flexible hoses having a length absorbing portion disposed in the swivel base for absorbing variations in hose length occurring with vertical movement of the boom.

As noted above, this invention employs a construction in which a curved length absorbing portion is disposed in the swivel base, rather than on the boom, for absorbing variations in hose length occurring with vertical movement of the boom. Thus, when an excavating operation is performed by moving the boom up and down and swinging the arm, the group of flexible hoses does not bulge to obstruct view. Moreover, the operator need not concern the hoses contacting the swivel base (swivel body) and can therefore move the boom up and down quickly to improve operability.

In addition to the above construction, the swivel base may have a swing bracket pivotally attached thereto for swinging the excavating implement about a vertical axis, the boom may have a forked portion connected to the swing bracket, and the forked portion may define a guide surface inclined downward toward the swing bracket to guide the group of flexible hoses in a space surrounded by the forked portion. Since the group of hoses is guided along the inclined surface, the hoses are reliably prevented from lifting (bulging) from the boom.

It is also preferred that the forked portion has a clamp for holding the group of flexible hoses extending through the space to follow the guide surface.

The group of flexible hoses may extend fore and aft through the swing bracket. Then, the group of flexible hoses moves fore and aft with vertical movement of the boom to absorb variations in hose length. This allows a diminishment of the degree of curvature of the length absorbing portion disposed in the swivel, to reduce the chance of its interference with various equipment disposed in the swivel base. The length absorbing portion does not undergo complex up and down and right and left movements, thereby avoiding twisting of the hoses.

By forming the length absorbing portion in the swivel base, its curving or bulging direction may be upward or horizontal, which may be determined by taking various equipment in the swivel base into account. Thus, the hoses may be arranged with an increased degree of freedom.

Further, it is recommended that the group of flexible hoses includes a first group of hoses extending through the swing bracket to the boom cylinder, and a second group of hoses connected to the arm cylinder and the bucket cylinder, and that the second group of hoses is passed upward through a space formed in a bottom portion of the boom.

With this construction, the group of hoses (first group of hoses) for the boom cylinder does not protrude from the bottom portion of the boom. This group of hoses and the group of working hoses (second group of hoses for the bucket and arm) are separated to facilitate maintenance of the group of working hoses.

The group of hoses may further include a third group of hoses connected to a service port, the first, second and third groups of hoses being arranged parallel to one another on a surface of the boom and connected to steel pipes through a relay unit.

With this construction, the group of working hoses (second and third groups of hoses) are arranged parallel within a width of the boom to extend longitudinally of the boom. Thus, the hoses are not obstructive to view, and have a reduced chance of interference with other objects.

These and other features, functions, effects and advantages of the present invention will be appreciated upon reading the following description with reference to the drawings.

DETAILED DESCRIPTION OF THE PREFERRED EMBODIMENTS

A preferred embodiment of this invention will be described hereinafter based on a backhoe which is one example of excavators.

Figure 1:
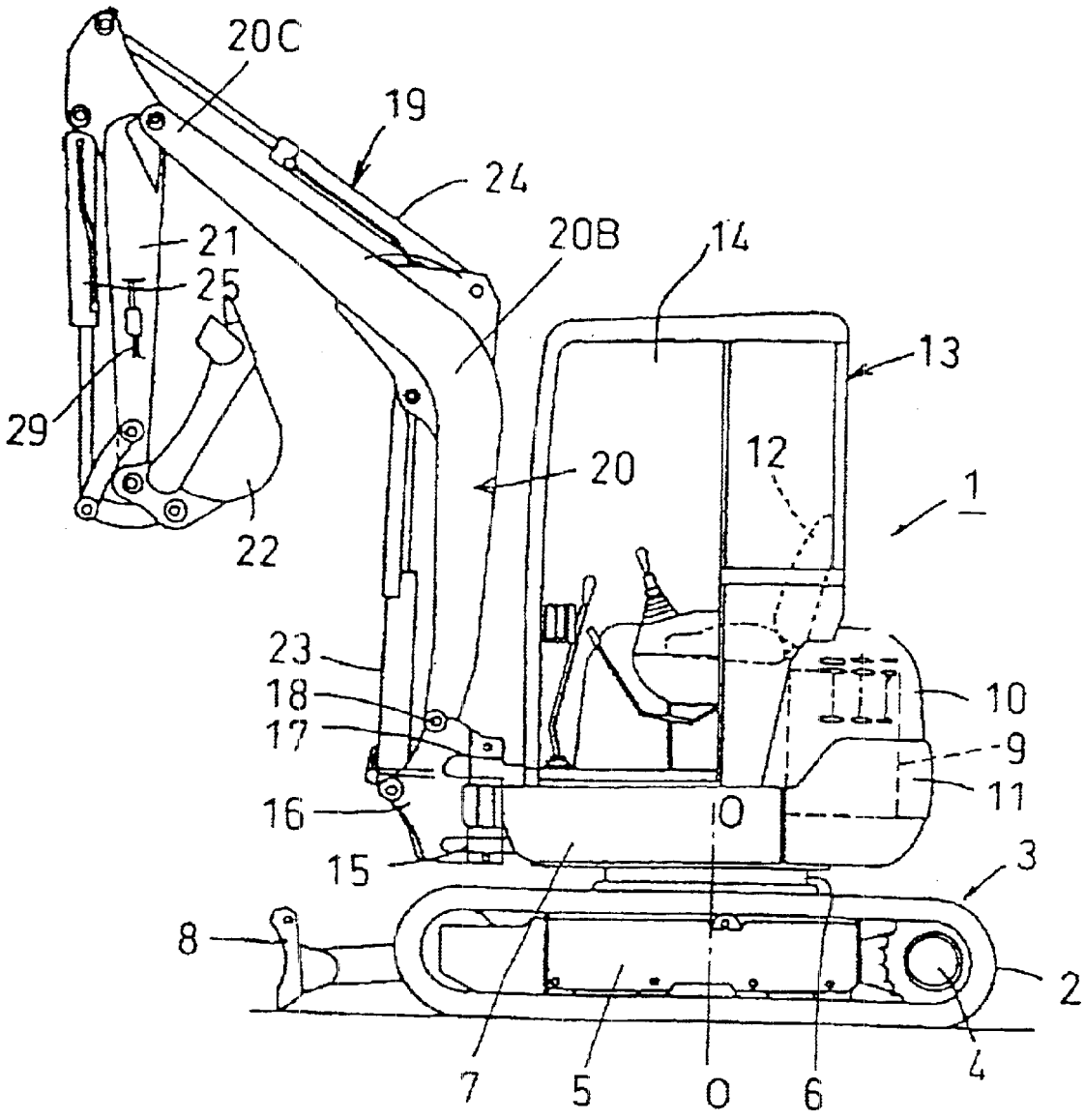
FIG. 1 is a side elevation of a backhoe which is one example of excavators according to this invention.

FIG. 1 shows an overall construction of the excavator (backhoe) 1. The backhoe 1 has right and left crawlers 2 exemplifying a running device 3 with drive sprockets driven by a hydraulic propelling motor 4, for example.

A swivel base (swivel body) 7 is mounted above the running device 3, or above a track frame 5 substantially supporting the right and left crawlers 2, to be swivelable completely (through 360 degrees) about a vertical axis O—O through a swivel bearing 6. A bulldozer blade 8 is attached to the front of track frame 5 between the right and left crawlers 2.

An engine 9 is mounted on an upper rear surface of swivel base 7. The engine 9 is covered by a hood (body cover) 10 and protected by a protector 11. A seat 12 is mounted on the hood 10.

A drive control device including the seat 12 is disposed in a cab 13. The cab 13 has entrances with doors 14 that may be opened, closed and locked.

A mounting bracket 15 is secured to and projects forward from a transversely intermediate position at the front of swivel base 7. A swing bracket 16 is pivotally attached to the mounting bracket 15 through a vertical axis 17 to be swingable right and left (pivotable about the vertical axis). An extendible and contractible cylinder exemplifying a swing cylinder (not shown) extends between the swing bracket 16 and swivel base 7. This cylinder is extendible and contractible to swing the swing bracket 16 right and left.

The swing bracket 16 supports an excavating implement 19 to be movable up down about a horizontal pivot 18. The excavating implement 19 includes, as main components thereof, a boom structure 20, and an arm 21 vertically pivotably (flexibly) attached to a distal end (top connection) of the boom structure 20. A bucket 22 is attached to a distal end of the arm 21 to be pivotable relative thereto (to take scooping or scraping action, discharge action and loading action). Thus, the excavating implement 19 is driven by extension and retraction of hydraulic actuators such as a boom cylinder 23, an arm cylinder 24 and a bucket cylinder 25 to perform an excavating operation such as ditch digging and a loading operation.

That is, the excavating implement 19 includes the boom 20 movable up and down by the boom cylinder 23, the arm 20 pivotally attached to the top of the boom 20 to be flexible relative thereto by the arm cylinder 24, and the bucket 22 pivotally attached to the top of the arm 21 to be driven by the bucket cylinder 25 to take dumping and scooping action. The cylinders 23, 24 and 25 are connected through a group of flexible hoses P to control valves 100 arranged on the swivel base (vehicle body) 7 for supplying and draining pressure oil to/from the cylinders.

Next, details of the construction of the boom structure 20 and movement of the group of hoses P occurring with movement of the boom structure 20 will be described with reference to FIGS. 2A–2D and FIGS. 3 through 5.

In FIG. 1 and FIGS. 2A–2D, the boom structure 20 is boomerang-shaped in side view, tapering from a curved portion in a longitudinally intermediate position thereof toward a bottom connection (forked proximal end) 20A and top connection 20C. Thus, the boom structure 20 has a main boom body 20B of boomerang profile (bow-shaped or L-shaped) in side view.

Figure 2A:
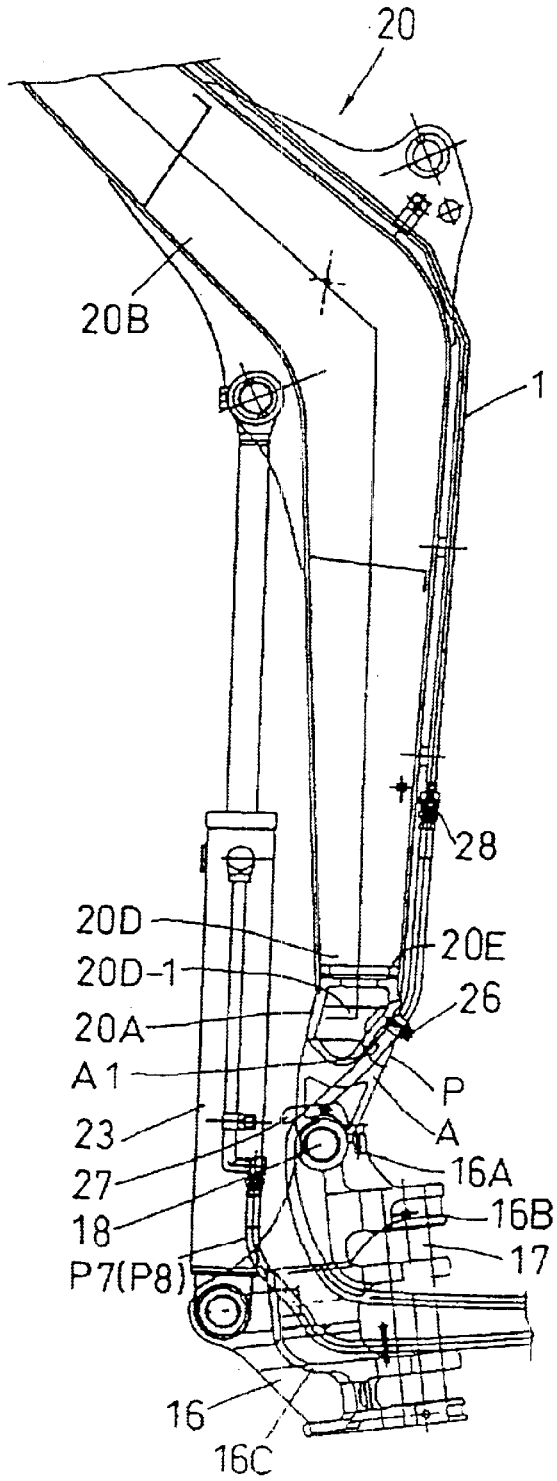
FIG. 2A is an elevation showing a relationship between a boom structure and a group of hoses, with the boom placed in an uppermost position.
Figure 2B:
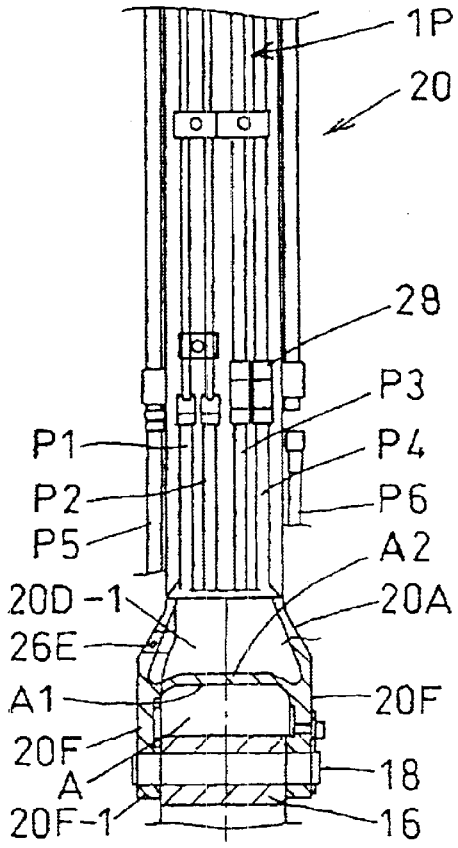
FIG. 2B is a rear view showing a principal portion of FIG. 2A.
Figure 2C:
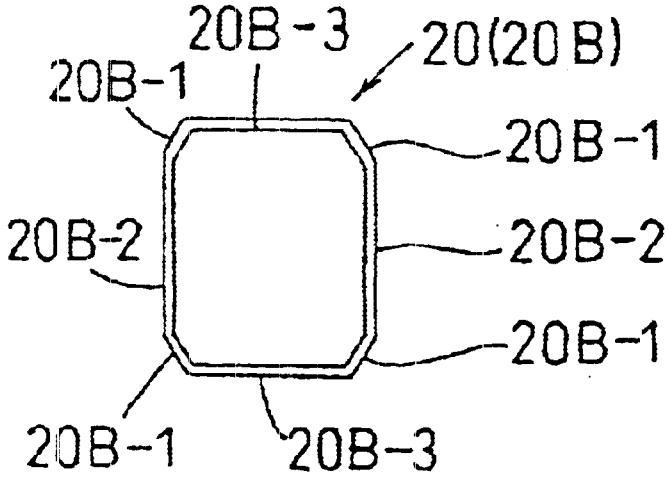
FIG. 2C is a sectional view of the boom in FIG. 2A.

The main boom body 20B of boom structure 20 has a box-like hollow section with chamfered corners 20B-1 as shown in FIG. 2C. The main boom body 20B has a pair of channel members 20B-2 formed of pressed or bent metal plate such as steel plate or iron plate placed in abutment and welded as at 20B-3 longitudinally along the abutted joints.

The bottom connection (forked proximal end) 20A of boom structure 20 has an engaging portion 20E spigot-connected (fitted in from below) to a lower opening 20D of main boom body 20B as shown in FIG. 1. This engaging portion 20E is formed as a forked base to define a pair of right and left arms 20F diverging and then extending parallel to each other. The pair of arms 20F define receiving bores 20F-1 in opposed positions thereof for receiving the pivot 18.

The entire bottom connection 20A is formed of metal such as cast steel, with the engaging portion 20E fitted in the lower opening 20D and edges of the engagement welded together.

As shown in FIG. 2B, the swing bracket 16 is connected to the forked proximal end 20A of boom structure 20, specifically to the transverse pivot 18 as sandwiched between the pair of arms 20F. A space A is formed forwardly of the pivot 18 as enclosed in the forked proximal end 20A, and the group of hoses P for transmitting pressure oil is passed upward through the space A.

The forked proximal end 20A has a downwardly inclined guide surface A1 formed in a fork base to be integral with the arms 20F for guiding the group of hoses P.

That is, the guide surface A1 is formed on the fork base of the forked proximal end 20A to be inclined downward from an upper surface of main boom body 20B toward the pivot 18 for guiding the group of hoses P. A partition wall A2 having the guide surface A1 has a triangular section as shown in FIG. 2A. The partition wall A2 has a hollow 20D-1 communicating with the opening 20D. The forked proximal end 20A is reinforced with the right and left arms 20F interconnected by bridging action of the partition wall A2 while achieving a lightweight construction (lightness of the entire boom) based on the hollow 20D-1.

A hose clamp 26 is disposed on the upper surface of main boom body 20B adjacent the guide surface A1 of the forked proximal end 20A for holding the group of hoses P extending upward through space A.

Figure 5:
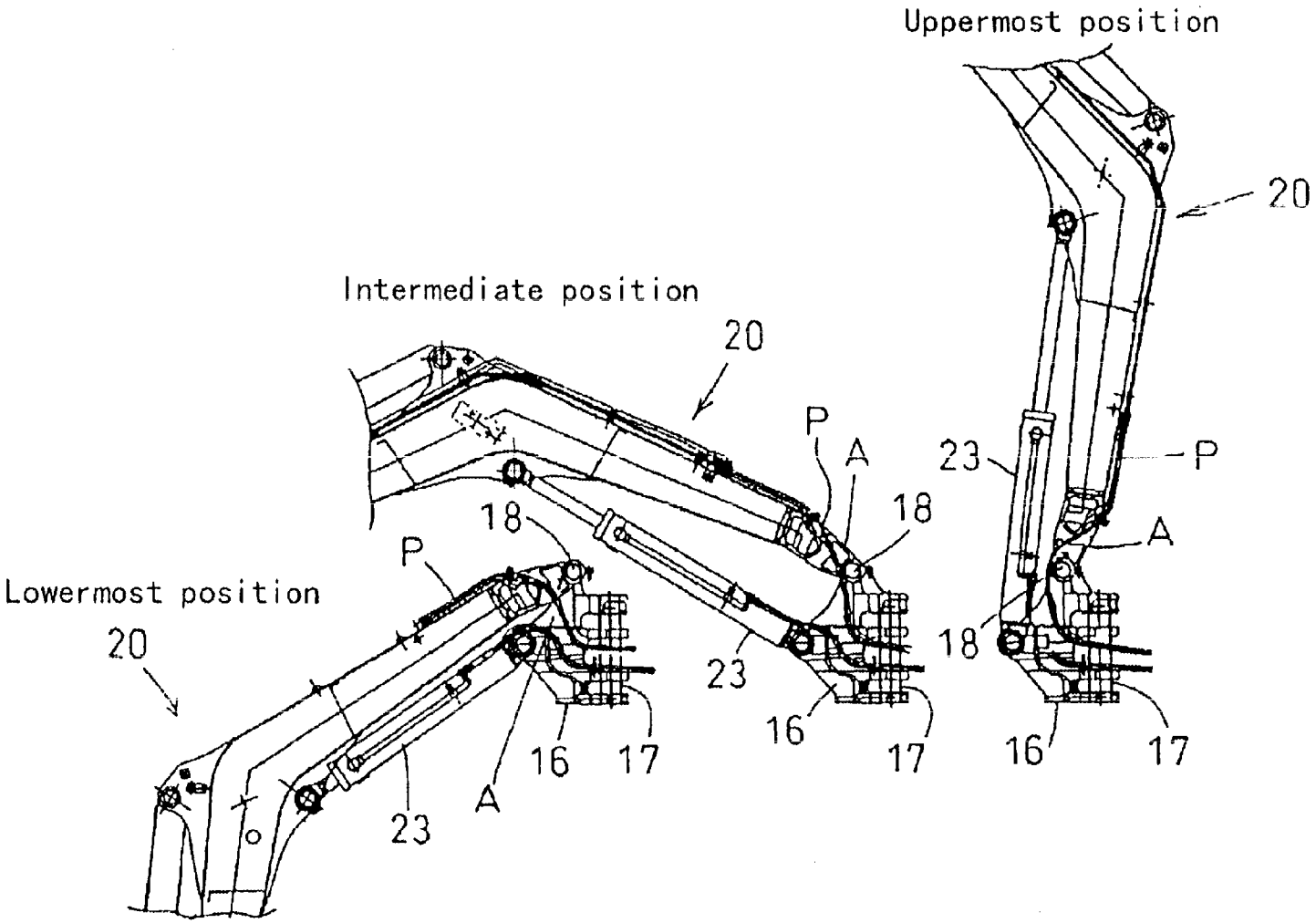
FIG. 5 are side views showing, from right to left, the uppermost position, intermediate position and lowermost position of the boom, respectively.
Figure 6:
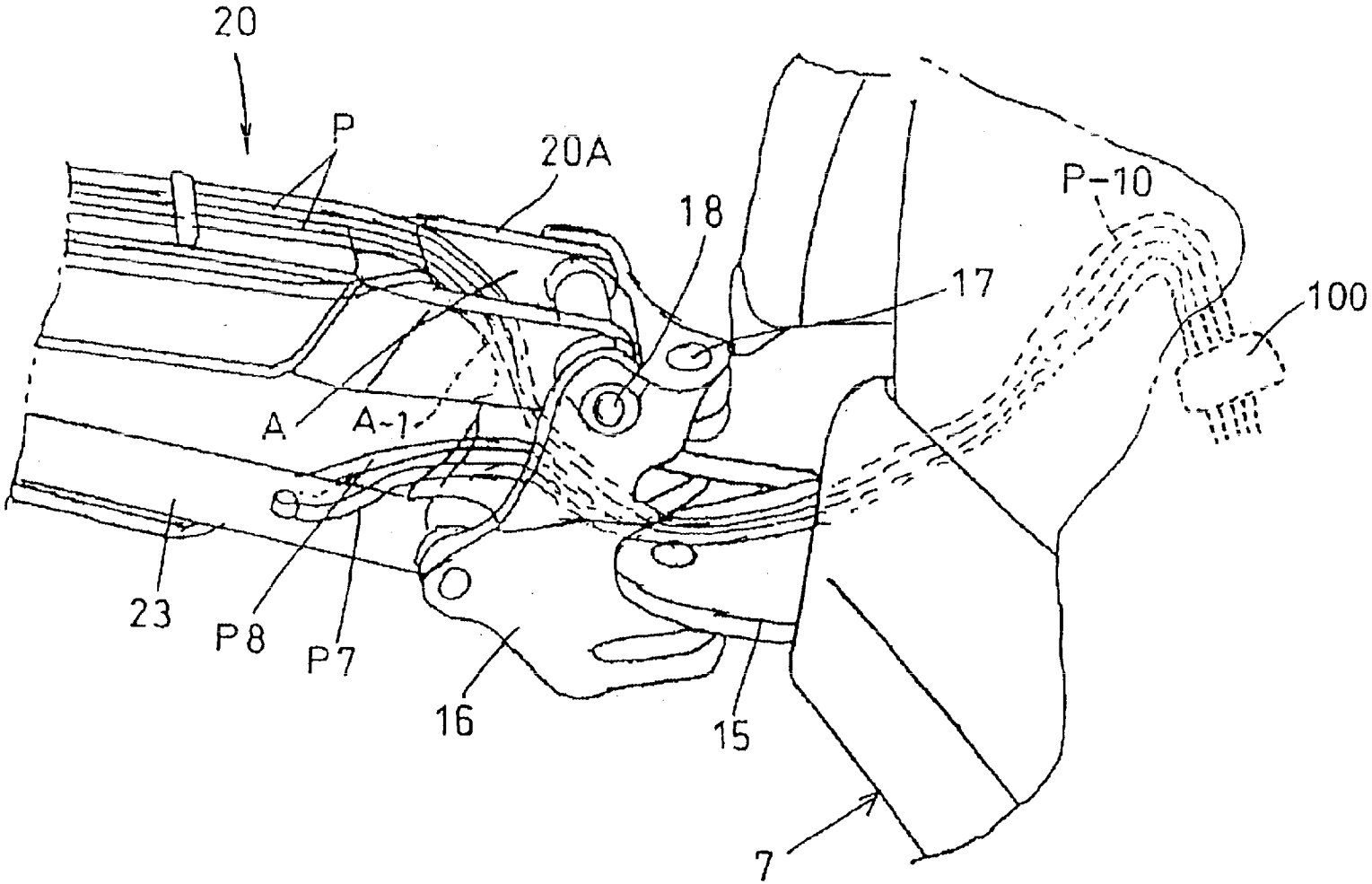
FIG. 6 is a perspective view of a principal portion in another embodiment of this invention.

The group of hoses P includes a total of six hoses consisting of two supply and drain hoses P1 and P2 for extending and contacting the arm cylinder 24, two supply and drain hoses P3 and P4 for extending and contacting the bucket cylinder 25, and two supply and drain hoses P5 and P6 which are service hoses for hydraulic equipment such as a breaker. A total of eight hoses including two supply and drain hoses P7 and P8 for extending and contacting the boom cylinder 23 extend through the swing bracket 16 and mounting bracket 15 as shown in FIG. 6 also, to be connected to the respective control valves (not shown) disposed on the swivel base 7. The hoses P1–P8 are flexible and resistant to pressure, and are capable of following the behavior (flexion, right and left swinging and so on) of excavating implement 19. Hose length is greatly variable between an uppermost position of the boom 20 and a lowermost position of the boom 20 shown in FIG. 5. To absorb the differences in hose length, the flexible hoses P1–P8 include a curved portion (length absorbing portion) P-10 inside the swivel base 7 (see FIG. 6).

In the prior art, this length absorbing portion is formed adjacent the bottom connection 20A of boom 20. With such an arrangement, when the boom 20 in the uppermost position as shown in FIG. 5, the hoses would interfere with the front of cabs 13, for example. In the case of a cab-less excavator, the hoses would impair visibility. By forming the length absorbing portion P-10 inside the swivel base 7 as shown in FIG. 6, good visibility is maintained. In addition, the hoses P1–P8 are passed between upper and lower partition walls 16B and 16C formed in the swing bracket 16. These 16B and 16C serve to protect the hoses P1–P8 inside the swing bracket 16 and reinforce the bracket 16.

Further, the group of flexible hoses P is clamped by the clamp body 26 adjacent the guide surface A1 to retain in place the group of hoses P extending along the guide surface A1.

Figure 2D:
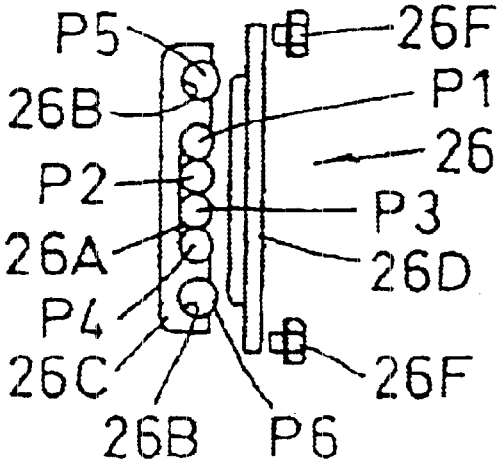
FIG. 2D is an exploded view of a clamp in FIG. 2A.

As shown in FIG. 2D, the clamp 26 includes an elastic holder (cushion holder) 26C defining grooves 26A for holding the hoses P1–P4 in parallel, and grooves 26B for holding the hoses P5 and P6 in separate, right and left positions. A hose presser 26D is provided to press the hoses P1–P6 in these grooves. The presser 26D is attached by bolts 26F screwed into threaded bores 26E shown in FIG. 2B.

By providing this clamp 26, passing the group of hoses P upward through the space A and along the guide surface A1, and forming the length absorbing portion P-10 in the swivel base 7, the group of hoses P contacts a lower portion of the pivot 18 (in substance a tube receiving the pivot 18) when the boom 20 in the uppermost position and intermediate position shown in FIG. 5. The group of hoses P moves only to the extent of coming out of contact with the pivot 18 when the boom 20 moves to the lowermost position. Thus, the group of hoses P is prevented from bulging toward the cab 13 or driver's seat 12 despite the vertical movement (flexion) of the boom 20.

A suspender mounting screw 16A is formed on an upper surface of swing bracket 16 for use in loading and unloading of the swivel working implement 1 for transport and for assembly and disassembly thereof. This mounting screw 16A may be used to detachably attach a clamp (hose guide rod) 27 for holding the group of hoses P against unnecessary movement.

The group of flexible hoses P extending upward through the space A is connected to a group of steel pipes P1 through relays (one-touch coupler) 28 on the upper surface of boom structure 20 for supplying and draining pressure oil to/from the arm cylinder 24, bucket cylinder 25 and service port 29. The group of flexible hoses P and the group of steel pipes 1P are arranged parallel (arranged together) within the width of the upper surface of main boom body 20B. Thus, the group of hoses P and the group of pipes 1P are contained neatly without deviating from the boom width to present no obstruction to the operator's view.

The hoses P7 and P8 for supplying and draining pressure oil to/from the boom cylinder 23 are passed through the swing bracket 16 and connected to the control valve on the swivel base 7. Thus, these hoses P7 and P8 are not obstructive to view, either.

Figure 7:
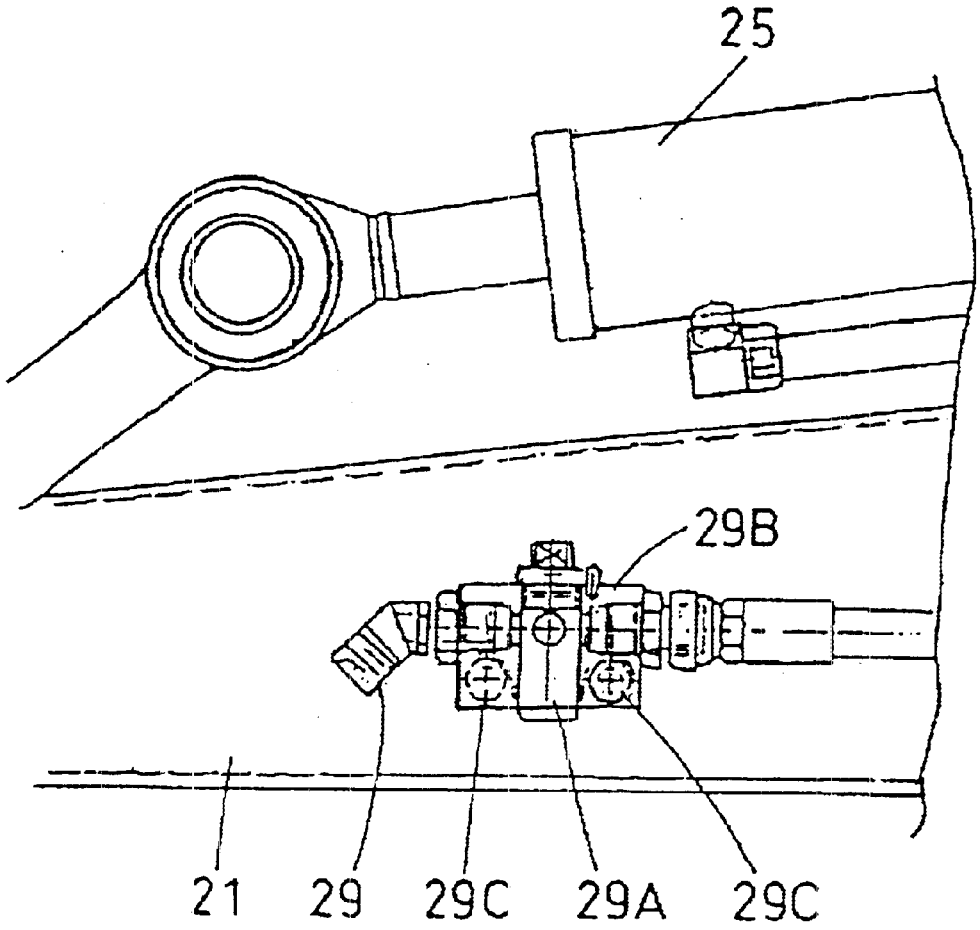
FIG. 7 is an enlarged view of a service port.
Figure 8A:
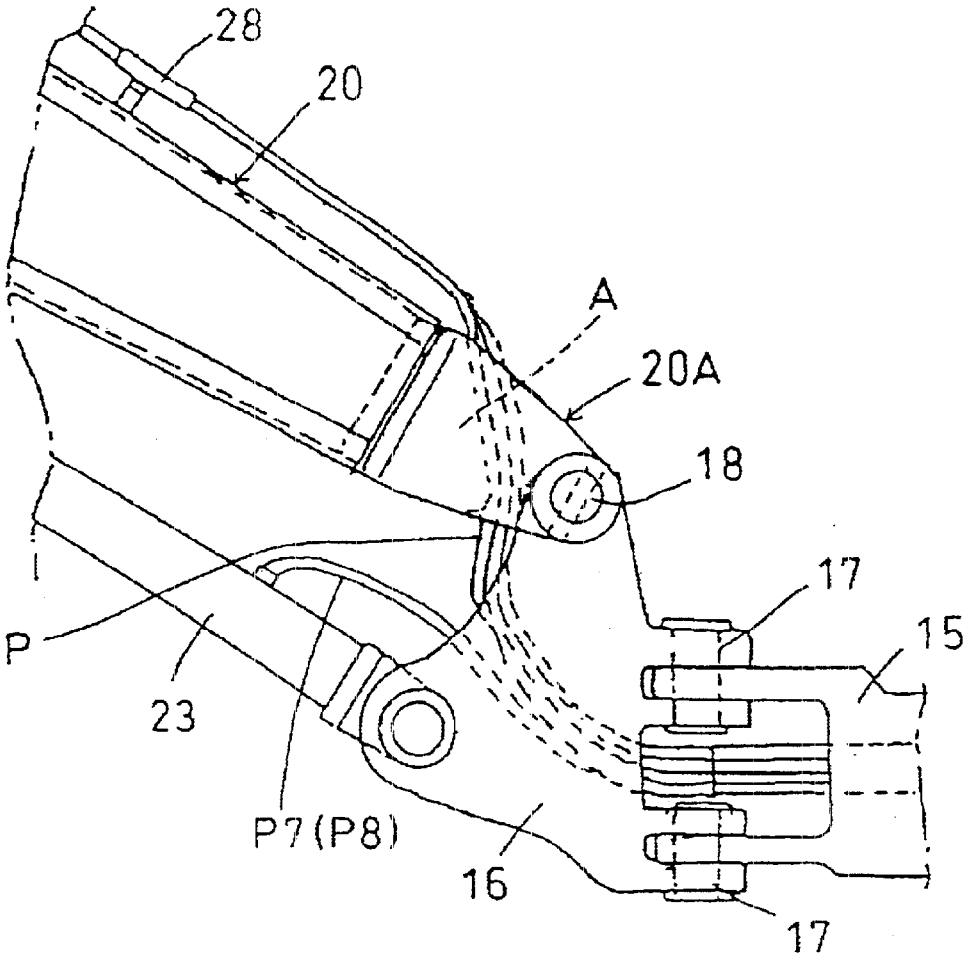
FIG. 8A is a side view in a further embodiment of this invention.
Figure 8B:
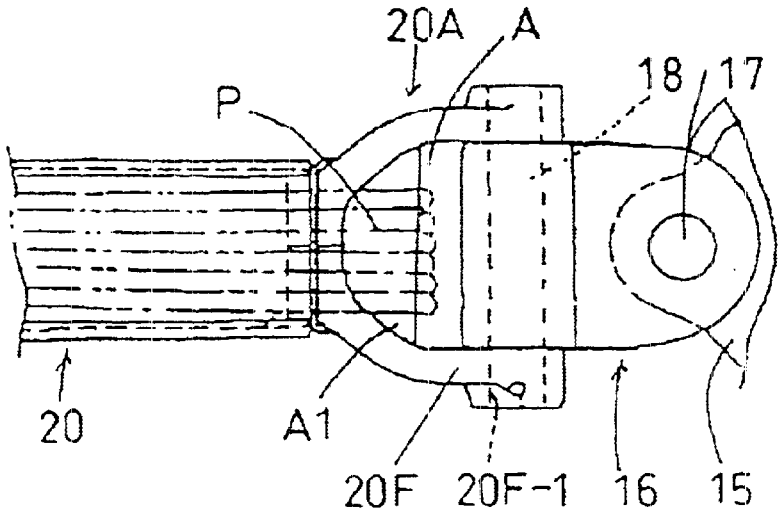
FIG. 8B is a plan view of FIG. 8A.
Figure 9A:
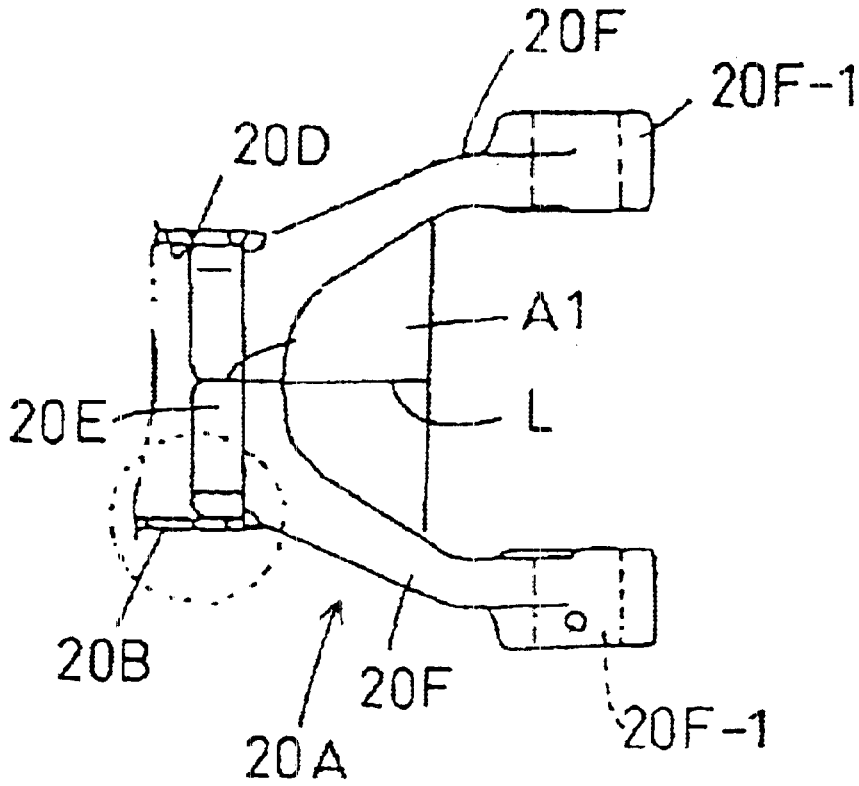
FIG. 9A is a plan view showing a principal portion of FIGS. 8A and 8B.
Figure 9B:
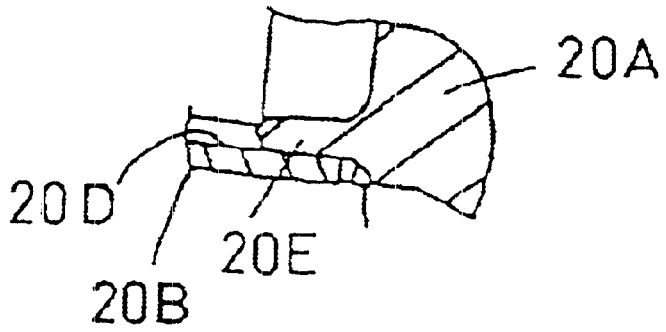
FIG. 9B shows a fragmentary section of FIG. 9A.

Further, as shown in FIG. 7, the service port 29 has a stop valve 29A with a valve body 29B fixed to a side surface of the arm by bolts 29C. The stop valve 29A is rotatable about its axis to stop supply of pressure oil to the service port 29. A fore and aft length is reduced by incorporating the stop valve 29A into the valve body 29B to be rotatable relative thereto.

Figure 3:
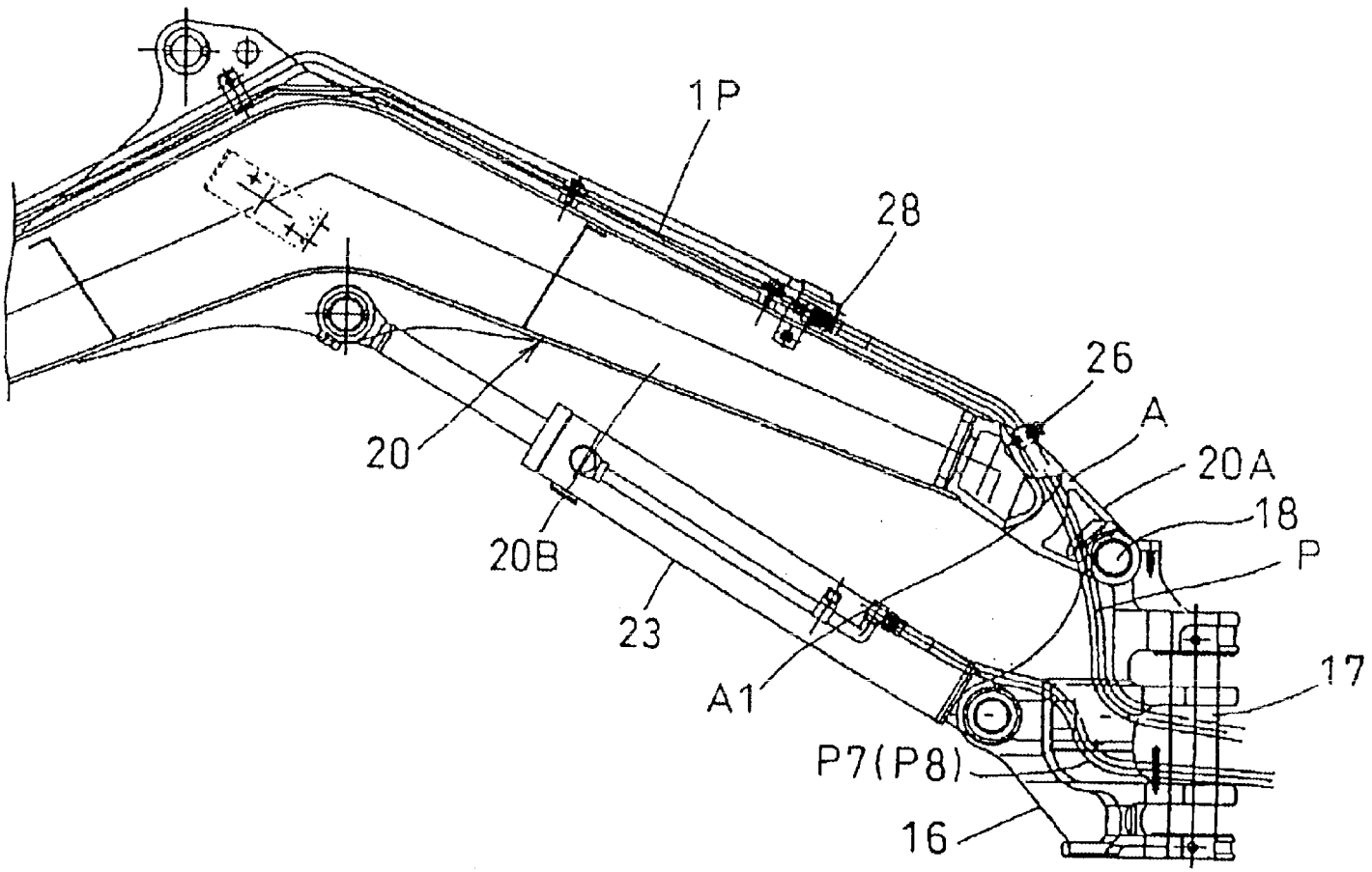
FIG. 3 is a side view of the boom in an intermediate position.
Figure 4:
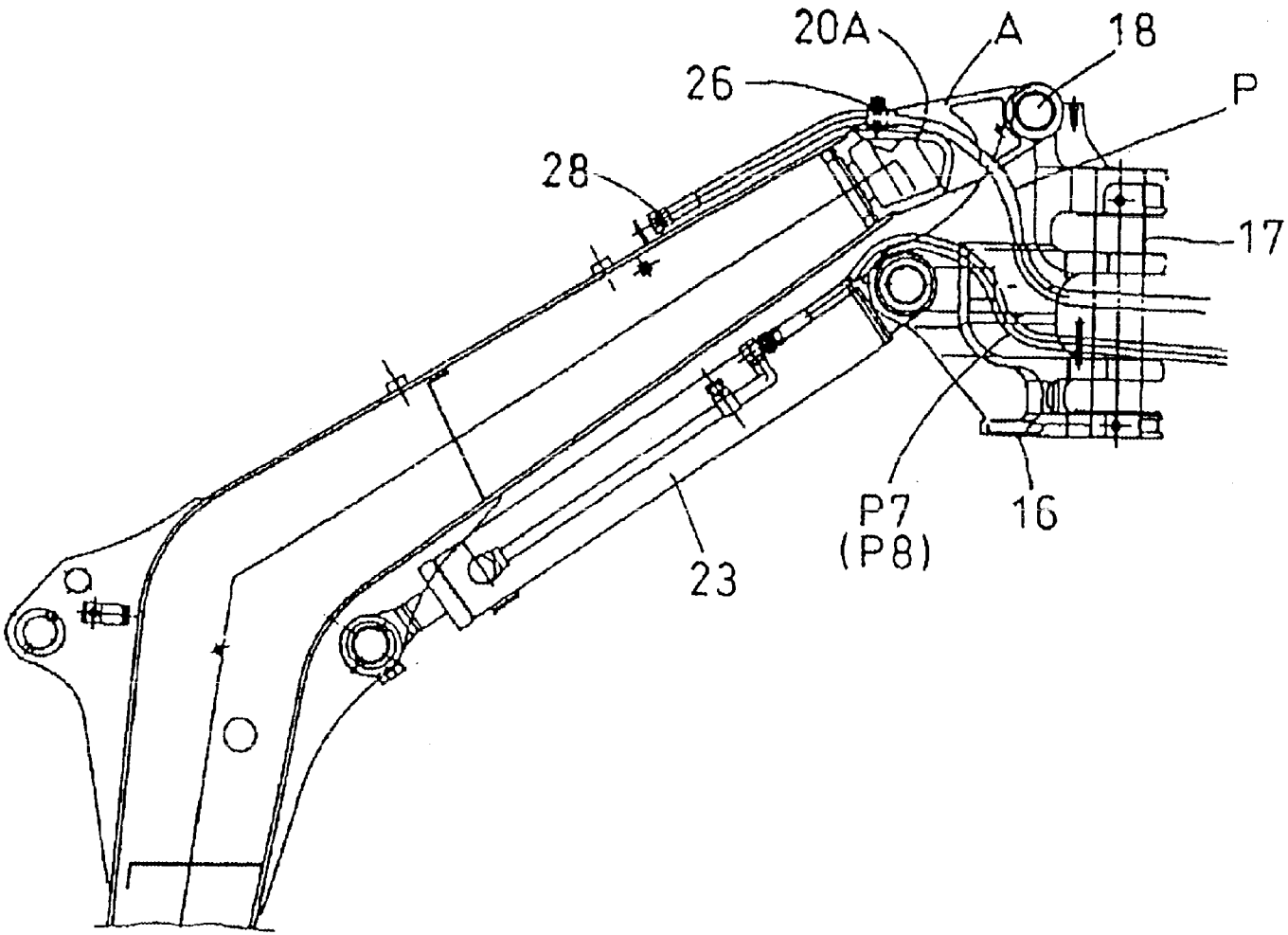
FIG. 4 is a side view of the boom in a lowermost position.

Further, FIG. 3 shows details of the group of hoses P and the boom structure 20 in the intermediate position shown in FIG. 5. FIG. 4 shows details of the group of hoses P and the boom structure 20 in the lowermost position shown in FIG. 5. Like reference numerals are used to identify like parts of the boom structure 20 in the uppermost position shown in FIG. 2A.

FIG. 6 shows another embodiment of this invention, in which the forked proximal end 20A of the boom structure 20 is attached to the transverse pivot 18 as sandwiched by the swing bracket 16, with a space A surrounded by the forked proximal end 20A forwardly of the pivot 18. The guide surface A1 for guiding the group of hoses P is the same as in the preceding embodiment. Like reference numerals are used to identify like parts, which will not be described again.

FIGS. 8A–8B and FIGS. 9A–9B show a further embodiment of this invention, in which the forked proximal end (bottom connection) 20A is divided at the center (abutting plane L) and welded together at the abutting plane L. The other aspects of the construction are the same as in the first embodiment shown in FIGS. 2 through 5, and like reference numerals are used to identify like parts.

In each of the above embodiments, the top connection 20C has the same construction as the bottom connection 20A.

According to this invention, as described hereinbefore, the group of hoses does not obstruct view and has improved durability.

What is claimed is:

1. An excavator, comprising:

a traveling device;

a swivel base supported by said traveling device, said swivel base having control valves;

a swing bracket connected to said swivel base to be laterally pivotable about a vertical axis;

an excavating implement supported on said swivel base by means of said swing bracket, said excavating implement including:

a boom, said boom having a forked portion connected to said swing bracket;

a boom cylinder for vertically moving said boom about a horizontal axis extending across said forked portion;

an arm pivotally attached to a top end of said boom;

an arm cylinder for swinging said arm;

a bucket pivotally attached to a top end of said arm; and a bucket cylinder for driving said bucket to effect a scooping and dumping action; and a group of flexible hoses connected between said control valves and said boom, arm, and bucket cylinders for transmitting said pressure oil therebetween to supply and drain the pressure oil to/from said cylinders, respectively, said group of flexible hoses having a length absorbing portion disposed within said swivel base for absorbing variations in hose length occurring with vertical movement of said boom, wherein said forked portion defines a guide surface in a space surrounded by said forked portion, and said guide surface being inclined downward toward said swing bracket to guide said group of flexible hoses from said forked portion to said swing bracket.

2. An excavator as defined in claim 1, wherein said forked portion has a clamp for holding said group of flexible hoses extending through said space to follow said guide surface.

3. An excavator as defined in claim 1, wherein said group of flexible hoses extends fore and aft through said swing bracket.

4. An excavator as defined in claim 1, wherein:

said group of flexible hoses includes a first group of hoses extending through said swing bracket to said boom cylinder, and a second group of hoses connected to said arm cylinder and said bucket cylinder; and said second group of hoses is passed upward through a space formed in a bottom portion of said boom.

5. An excavator as defined in claim 4, wherein said group of hoses further includes a third group of hoses connected to a service port, said first, second and third groups of hoses being arranged parallel to one another on a surface of said boom and connected to steel pipes through a relay unit.

6. An excavator as defined in claim 1, wherein said forked portion includes right and left lateral walls and said guide surface is defined between said right and left lateral walls.

* * * * *